United States Patent [19]

Toshiyasu et al.

[11] Patent Number: 4,634,930

[45] Date of Patent: Jan. 6, 1987

[54] DISPLAY DEVICE

[75] Inventors: Masayuki Toshiyasu, Muko; Toshinari Kawahara, Nagaoka-Kyo, both of Japan

[73] Assignee: Mitsubishi Denki Kabushiki Kaisha, Tokyo, Japan

[21] Appl. No.: 697,527

[22] Filed: Feb. 1, 1985

[30] Foreign Application Priority Data

Apr. 13, 1984 [JP] Japan ..... 59-75242

[51] Int. Cl.[4] ..... H01J 29/06

[52] U.S. Cl. ..... 315/8; 335/214; 335/219; 315/85; 361/149

[58] Field of Search ..... 335/214, 219; 315/8, 315/85; 361/149, 150; 358/254

[56] References Cited

U.S. PATENT DOCUMENTS

| | | | |
|---|---|---|---|
| 3,329,871 | 7/1967 | Smith | 315/8 |
| 3,746,910 | 7/1973 | Aber | 315/8 |
| 3,872,347 | 3/1975 | Matsushima | 315/8 |
| 3,887,833 | 6/1975 | Yamazaki | 315/8 |
| 3,947,632 | 3/1976 | Giger et al. | 315/8 |
| 4,517,494 | 5/1985 | Yasui et al. | 315/8 |

*Primary Examiner*—Saxfield Chatmon

*Attorney, Agent, or Firm*—Oblon, Fisher, Spivak, McClelland, & Maier

[57] ABSTRACT

A display device comprising a cabinet and an electromagnetic deflection yoke and a horizontal width adjusting coil received is the cabinet comprises a canceling coil for canceling electromagnetic field noise generated from the electromagnetic deflection yoke received in the cabinet.

13 Claims, 3 Drawing Figures

DISPLAY DEVICE

BACKGROUND OF THE INVENTION

1. Field of the Invention

The present invention relates to a display device or a television receiver used in combination with a computer device such as a personal computer. More particularly, it relates to a display device for giving remarkable reduction in disturbing noise which adversely affects a magnetic memory device, for instance, a floppy disc drive.

2. Description of Prior Art

Personal computers have more and more been developed and used in wide range. Various type of the personal computers have been presented in commercial scale along with a display device or color-television receiver.

It is a recent tendency to provide a separate type personal computer in which a main body of C.P.U., a key board and a display device are separated and a magnetic memory device such as a floppy disc drive (hereinbelow referred to as a FDD) is placed in the C.P.U.

FIG. 1 is a schematic view in combination of these devices. In FIG. 1, a reference numeral 1 designates a main casing inclusive of a C.P.U. as an essential part of a personal computer (referred to as C.P.U.), numeral 2 designates a magnetic memory device consisting of FDD as an auxiliary memory device, a numeral 3 designates a key board and a numeral 4 designates a display device which may be one of an exclusive use or a television receiver which receives a signal at an antenna input part through a converter. In the C.P.U. 1 in such a system, a magnetic head (not shown) is provided in the magnetic memory device 2 and is electromagnetically coupled to a disket used for the magnetic memory device to write in and read out signals. In the system, however, when a needless magnetic field is formed around the magnetic head, there causes overlapping of needless noise coupled with the magnetic head on the original signal thereby causing malfunction of the magnetic memory device 2. Particularly, when the display device 4 is directly put on the C.P.U. 1 as shown FIG. 1, electromagnetic field noise emitted from the display device 4 is directly effected to the magnetic memory device 2 to cause a fatal defect. As electromagnetic field noise emitted from the display device 4, there is leakage flux having a horizontal deflection frequency produced from coils which are mainly used in a horizontal deflection system comprising a deflection yoke, a flyback transformer, a horizontal width adjusting coil and so on and switching noise in a power source circuit. The former is noise of 15.7 KHz–24 KHz and the latter is one having a frequency component produced by switching the power source circuit. Interference noise is also generated from a copper-layered pattern on a substrate on which a power source and a deflection circuit are provided. Thus produced electromagnetic field noises are mainly caused by a leakage magnetic field emitted from the horizontal deflection coil in the deflection yoke. Accordingly, when an arrangement as shown in FIG. 1 is taken, the magnetic memory device 2 should not be adversely affected by the leakage magnetic field produced from the horizontal deflection coil to avoid malfunction of the device 2.

As an attempt to prevent the malfunction of the magnetic memory device 2 caused by the leakage magnetic filed from the horizontal deflection coil, it is considered that a shielding mat is interposed between the C.P.U. 1 and the display device 4. It is, however, disadvantageous in that handling works are troublesome and the quality of the system as a commodity is poor.

SUMMARY OF THE INVENTION

It is an object of the present invention to provide a display device having an electromagnetic deflection yoke in a cabinet in which a cancelling coil is installed in the cabinet to cancel electromagnetic field noise generated from an electromagnetic deflection yoke.

The foregoing and the other objects of the present invention have been attained by providing a display device comprising a cabinet, an electromagnetic deflection yoke and a horizontal width adjusting coil received in the cabinet which comprises a cancelling coil for cancelling electromagnetic field noise generated from the electromagnetic deflection yoke provided in the cabinet.

DETAILED DESCRIPTION OF THE INVENTION

Figure 1:
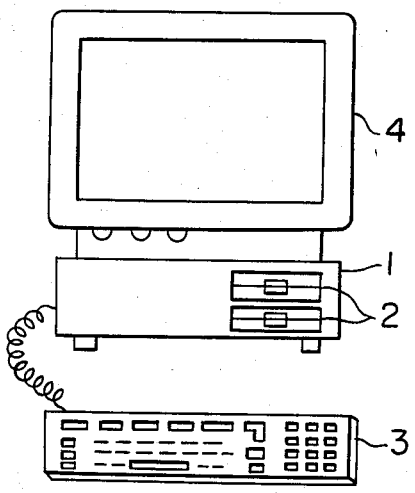
FIG. 1 is a schematic view showing combination of a display device and a personal computer.
Figure 2:
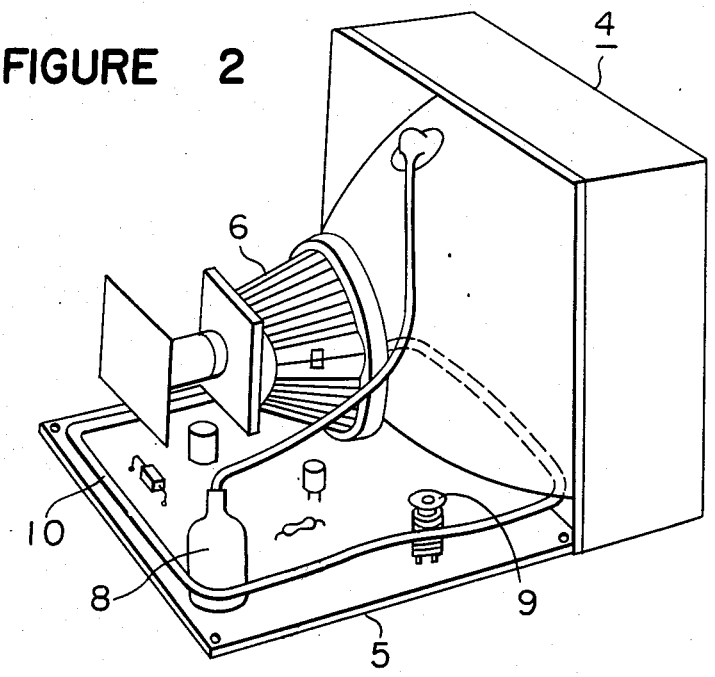
FIG. 2 is a perspective view of an important part of an embodiment of the display device according to the present invention.

An embodiment of the present invention will be described with reference to FIG. 2 showing a state of a display device by removing the outer casing of a cabinet. A reference numeral 5 designates a substrate having the lower surface on which a metallic layer of a copper-layered pattern is formed. A deflection yoke 6 provided with a horizontal deflection coil 7 is provided on the upper surface of the substrate 5. A flyback transformer 8 and a horizontal width adjusting coil 9 are also attached to the upper surface of the substrate 5. The coil 9, the deflection yoke 6 and flyback transformer 8 constitute a horizontal deflection system. A cancelling coil 10 consisting of a short circuit ring, i.e. a looped conducting coil is arranged along the outer circumference of the substrate 5 and a part of the cancelling coil 10 is positioned in the vicinity of the horizontal width adjusting coil 9. The cancelling coil 10 is arranged between the magnetic memory device 2 and the deflection yoke 6 when it is assembled as shown in FIG. 1.

Figure 3:
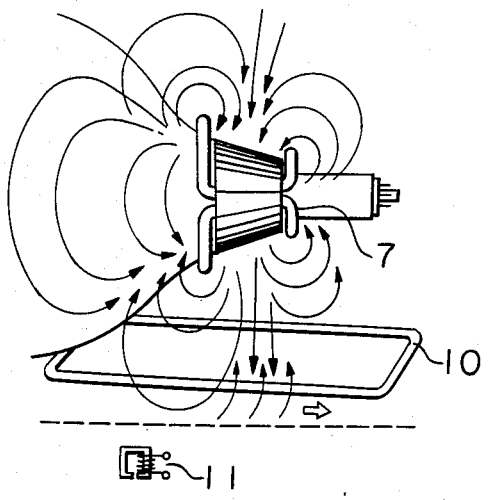
FIG. 3 is a schematic view for the purpose of explaining cancellation of electromagnetic noise generated from a horizontal deflection coil.

In the display device having the construction as above-mentioned, there takes place a magnetic field as shown by the solid arrow mark in FIG. 3, namely a leakage magnetic field extending from the top to the bottom in the figure causes electromagnetic noise. The electromagnetic noise is coupled to a magnetic head 11 of the magnetic memory device 2 thereby causing malfunction of the magnetic memory device 2. In the present invention, however, the electromagnetic noise is cancelled by the cancelling coil 10 without any adverse affect to the magnetic head 11 whereby risk of malfunction of the magnetic head 11 can be eliminated. Namely, the electromagnetic noise of an alternating magnetic field having a frequency band from 15.7 KHz–24 KHz is crossed to the cancelling coil 10 so that an inductive current flows in the cancelling coil 10. A magnetic field formed by conduction of the inductive current as shown by the broken arrow line in FIG. 3 cancels the electromagnetic noise. Further, in the embodiment of the present invention, since the cancelling coil is arranged in the vicinity of the horizontal width adjusting coil 9, the effect of cancellation of the electromagnetic field noise can be improved by the fact that a secondary inductive current from the horizontal width adjusting coil 9 which can be considered as a transformer flows in the cancelling coil 10 whereby a magnetic field is produced to cancel the electromagnetic field noise. The horizontal width adjusting coil 9 and the cancelling coil 10 are so designed to have relationship that the secondary inductive current flows in the cancelling coil 10 to form a magnetic field for cancelling the electromagnetic field noise.

In the embodiment of the present invention, provision of the cancelling coil 10 in a simple way effectively eliminates the electromagnetic noise from the deflection yoke 6. Thus constructed display device was assembled to the C.P.U. 1 as shown in FIG. 1 to operate the system and it was found that there was no erroneous operation of the magnetic memory device 2.

In the embodiment as described above, the cancelling coil is constituted by a short circuit ring; however, it is not limited to it and it is possible to use combination of a plurality of one turn coils or a coil having plural turns in which both ends of the coil are connected to form a short circuit. In the latter case, it is advantageous to have number of turns in a limited space which is effective to cancel the electromagnetic noise.

In the embodiment, the secondary inductive current is passed in the cancelling coil 10 by means of the horizontal width adjusting coil 9. However, the same effect can be obtained without passing the secondary inductive current. Further, it is possible to make a horizontal deflection current flowing in the horizontal deflection coil 7 to flow in the cancelling coil 10 in the direction for cancelling the electromagnetic field noise. Even in this case, effect of cancellation of the electromagnetic noise is great. The horizontal deflection current flowing in the cancelling coil 10 can be obtained by connecting the cancelling coil 10 to the horizontal deflection circuit in series.

In addition, it is possible to utilize both of the secondary inductive current by the horizontal width adjusting coil 9 and the horizontal deflection current.

As described above, the display device of the present invention is provided with a cancelling coil in the cabinet to cancel electromagnetic field noise generated from the electromagnetic deflection yoke and accordingly, the electromagnetic field noise is effectively suppressed by the cancelling coil and the electromagnetic field noise does not leak out of the cancelling coil.

The present invention has further advantage that when a device which is easily affected to electromagnetic noise, for instance, a magnetic memory device is arranged at the outer side of the cancelling coil of the display device, the device is not interposed by electromagnetic field noise generated from the electromagnetic deflection yoke of the display device.

What is claimed is:

1. A display device for a computer mounted in close proximity thereto, said display device comprising:

a cabinet, a cathode ray tube mounted in said cabinet;

an electromagnetic deflection yoke mounted on said cathode ray tube;

a horizontal width adjusting coil mounted in said cabinet; and a canceling coil mounted in said cabinet for canceling electromagnetic field noise generated from said electromagnetic deflection yoke and being arranged in the vicintiy of said cathode ray tube so that said electromagnetic field noise induces a current to flow therein, which causes a magnetic feed to be formed which reduces said electromagnetic field noise.

2. The display device according to claim 1, wherein a second current is induced in said cancelling coil by the horizontal width adjusting coil.

3. The display device according to claim 1, wherein said cancelling coil is constituted by a plurality of single turn short circuit rings.

4. The display device according to claim 1, wherein said cancelling coil is constituted by a single coil having a plurality of turns.

5. The display device according to claim 1, wherein said said cancelling oil is constituted by a short circuit ring.

6. The display device according to claim 1, wherein said cancelling coil is connected to a deflection output circuit including said electromagnetic deflection yoke to pass deflection current in the direction cancelling the electromagnetic field coil generated from said electromagnetic deflection yoke.

7. The display device according to claim 1, wherein at least a part of said cancelling coil is near said horizontal width adjusting coil.

8. The display device according to claim 5, wherein at least a part of said cancelling coil is near said horizontal width adjusting coil.

9. The display device according to claim 7, wherein at least a part of said cancelling coil is near said horizontal width adjusting coil.

10. The display device according to claim 1, wherein said cancelling coil is provided between a magnetic memory device of said computer used with said display device and said electromagnetic deflection coil.

11. The display device according to claim 5, wherein said cancelling coil is provided between a magnetic memory device of said computer used with said display device and said electromagnetic deflection coil.

12. The display device according to claim 6, wherein said cancelling coil is provided between a magnetic memory device of said computer used with said display device and said electromagnetic deflection coil.

13. The display device according to claim 7, wherein said cancelling coil is provided between a magnetic memory device of said computer used with said display device and said electromagnetic deflection coil.

* * * * *